United States Patent [19]

Horiuchi

[11] 4,449,498

[45] May 22, 1984

[54] IDLE-ADJUSTING DEVICE FOR AN INTERNAL COMBUSTION ENGINE

[75] Inventor: Tomofusa Horiuchi, Yokohama, Japan

[73] Assignee: Nissan Motor Company, Limited, Yokohama, Japan

[21] Appl. No.: 428,707

[22] Filed: Sep. 29, 1982

[30] Foreign Application Priority Data

Dec. 7, 1981 [JP] Japan ..... 56-182014

[51] Int. Cl.[3] ..... F02B 3/00; F02D 9/02; F02M 25/06

[52] U.S. Cl. ..... 123/339; 123/585

[58] Field of Search ..... 123/339, 531, 585, 588; 251/121, 122, 123, 125

[56] References Cited

U.S. PATENT DOCUMENTS

| | | | |
|---|---|---|---|
| 3,581,852 | 6/1971 | Griffen | 123/339 |
| 4,281,631 | 8/1981 | Yamaguchi | 123/339 |
| 4,354,465 | 10/1982 | Takeuchi et al. | 123/339 |
| 4,378,766 | 4/1983 | Yamozoe et al. | 123/585 |
| 4,378,767 | 4/1983 | Kobashi et al. | 123/339 |
| 4,387,682 | 6/1983 | Miyagi et al. | 123/339 |
| 4,389,996 | 6/1983 | Yaegashi et al. | 123/585 |
| 4,401,073 | 8/1983 | Furabushi | 123/339 |

FOREIGN PATENT DOCUMENTS

| | | | |
|---|---|---|---|
| 148938 | 11/1980 | Japan | 123/339 |

*Primary Examiner*—Raymond A. Nelli

*Attorney, Agent, or Firm*—Schwartz, Jeffery, Schwaab, Mack, Blumenthal & Koch

[57] ABSTRACT

An idle-adjusting device for an engine having an air intake passage and a throttle valve disposed in the air intake passage, includes an auxiliary passage communicating with the air intake passage in such a manner as to bypass the throttle valve. A first variable restriction is provided in the auxiliary passage to adjustably reduce the local cross-sectional area of the auxiliary passage. A second variable restriction is provided in the auxiliary passage downstream of the first restriction to adjustably reduce the local cross-sectional area of the auxiliary passage. The first and second restrictions adjustably determine the effective cross-sectional area of the auxiliary passage.

5 Claims, 4 Drawing Figures

IDLE-ADJUSTING DEVICE FOR AN INTERNAL COMBUSTION ENGINE

BACKGROUND OF THE INVENTION

This invention relates to a device for adjusting the flow rate of air or air-fuel-mixture drawn into an internal combustion engine during idling.

Internal combustion engines usually have an auxiliary air passage which is connected to a main air passage in such a manner as to bypass an engine throttle valve. The auxiliary passage permits air to be drawn into the engine when the throttle valve is closed. A screw is located in the auxiliary passage to adjust the effective cross-sectional area thereof to determine the flow rate of air drawn into the engine during idling.

The engines usually have positive crankcase ventilation (PCV) and exhaust gas recirculation (EGR) systems for the purpose of emission control. These systems inevitably discharge contaminants, such as oil or carbon particles, into fresh air in the air passages. In addition, some dirt will inevitably pass an air filter or cleaner and will be entrained in the air flowing through the air passages.

When dirt or other contaminants accumulate on the idle-adjusting screw, the effective cross-sectional area of the auxiliary passage decreases from the desired value, reducing the flow rate of air drawn into the engine during idling. This causes a reduction in the engine rotational speed during idling.

Accordingly, some idle-adjusting devices are arranged to prevent dirt or other contaminants from adhering thereto and accumulating thereon, thereby keeping engine idle speed at an optimal level.

SUMMARY OF THE INVENTION

It is an object of the present invention to provide an idle air or air-fuel-mixture flow-rate adjusting device for an internal combustion engine which is insensitive to accumulation of dirt or other contaminants thereon.

In accordance with this invention, an idle-adjusting device for an engine having an air intake passage and a throttle valve disposed in the air intake passage, includes an auxiliary passage communicating with the air intake passage in such a manner as to bypass the throttle valve. A first variable restriction is provided in the auxiliary passage to adjustably reduce the local cross-sectional area of the auxiliary passage. Similarly, a second variable restriction is provided in the auxiliary passage downstream of the first restriction to adjustably reduce the local cross-sectional area of the auxiliary passage. The first and second restrictions adjustably determine the effective cross-sectional area of the auxiliary passage.

The above and other objects, features and advantages of this invention will be apparent from the following description of preferred embodiments thereof, taken in conjunction with the drawings.

BRIEF DESCRIPTION OF THE DRAWINGS

Like reference numerals denote like parts throughout the drawings.

DESCRIPTION OF THE PREFERRED EMBODIMENTS

Figure 1:
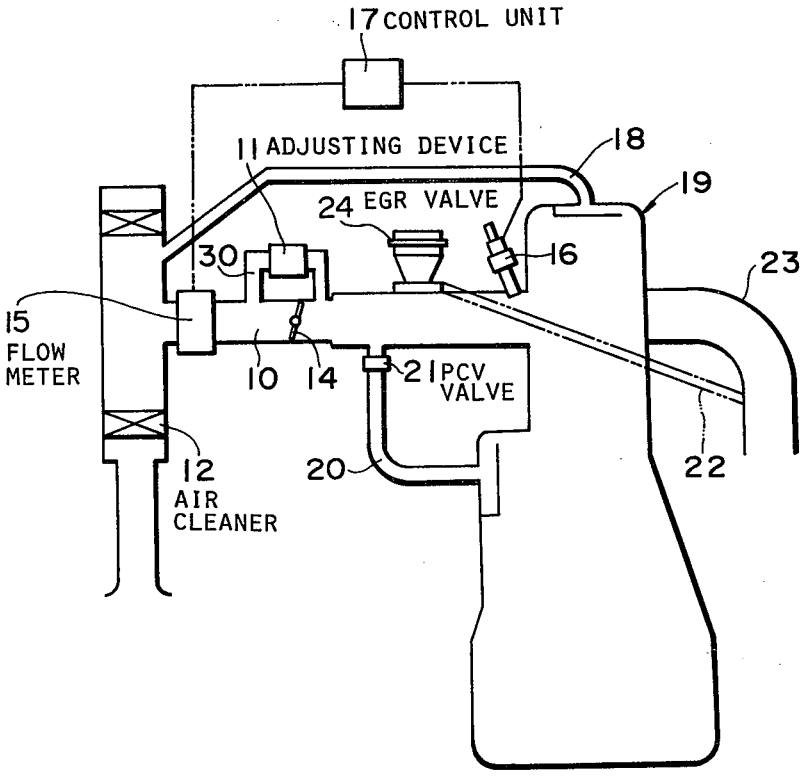
FIG. 1 is a diagram of an internal combustion engine air-intake system including an idle-adjusting device according to a first embodiment of this invention.

With reference to FIG. 1, there is shown an internal combustion engine air-intake system which includes an air intake passage 10 and an idle-adjusting device 11 according to a first embodiment of this invention. The air passage 10 is connected at one end to an air cleaner or filter 12 and at the other end to combustion chambers (not shown) to transmit fresh air from the cleaner 12 to the combustion chambers. However, unfilterable dirt will pass through or around the cleaner 12 and be entrained in the air. A throttle valve 14 is disposed in the air passage 10.

An air flow meter 15 is located in the air passage 10 upstream of the throttle valve 14 to measure the flow rate of air drawn into the combustion chambers. One or more fuel injection valves 16 open to the air passage 10 downstream of the throttle valve 14. A computer-equipped control unit 17 receives the air-flow-rate signal from the meter 15 and controls the fuel injection valves 16 in response to the air-flow-rate signal so as to supply the combustion chambers with air-fuel mixture of the desired air-fuel ratio.

A positive crankcase ventilation (PCV) intake passage 18 is connected at one end to the air passage 10 downstream of the air cleaner 12 but upstream of the air flow meter 15, and at the other end to a crankcase 19 so as to conduct fresh air to the crankcase 19. A PCV discharge passage 20 is connected at one end to the crankcase 19 and at the other end to the air passage 10 downstream of the throttle valve 14 so as to add air containing blow-by gas from the crankcase 19 to the air direction towards the combustion chambers. A PCV valve 21 is disposed in the discharge passage 20 to control the air flow through the passages 18 and 20. This PCV system inevitably discharges contaminants, such as oil, into the air in the passage 10.

An exhaust gas recirculation (EGR) passage 22 is connected at one end to an exhaust passage 23 and at the other end to the intake passage 10 downstream of the throttle valve 14, so as to recirculate a portion of exhaust gas through the combustion chambers. An EGR valve 24 is disposed in the passage 22 to control the rate of exhaust gas recirculation. This EGR system inevitably discharges contaminants, such as carbon particles, into the air in the passage 10.

One end of an auxiliary air passage 30 is connected to the main air passage 10 upstream of the throttle valve 14 but downstream of the air flow meter 15. The other end of the auxiliary passage 30 is connected to the main passage 10 downstream of the throttle valve 14 but upstream of the fuel injection valves 16, the junction with the PCV discharge passage 20, and that with the EGR passage 22. Thus, the auxiliary passage 30 bypasses the throttle valve 14 so as to allow some air to flow toward the combustion chambers when the throttle valve 14 is closed to idle the engine. The device 11 is disposed in the auxiliary passage 30 to adjust the effective cross-sectional area thereof so as to determine the flow rate of air drawn into the combustion chambers during idling.

All the above-mentioned structures of the internal combustion engine are essentially identical with those of a conventional engine, except the detailed arrangement of the idle-adjusting device 11, which will be explained immediately hereafter.

Figure 2:
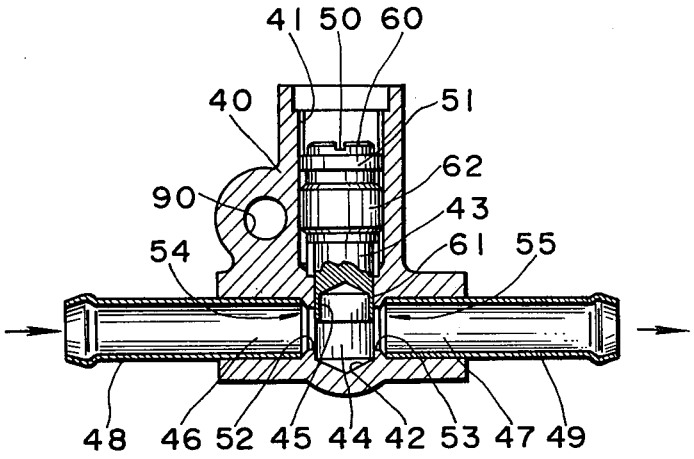
FIG. 2 is a longitudinal section view of the idle-adjusting device of FIG. 1.

As is shown in FIG. 2, the device 11 includes a housing 40 provided with a cylindrical hole 41 extending from the outside of the housing 40 and having a bottom 42. The hole 41 extends vertically in the drawing. A cylindrical screw 43 having a head 60 and a tip 61 at opposite ends is coaxially disposed in the hole 41. Although the shape of the tip 61 differs from that of the tip of a needle as described hereinafter, the end of the screw 43 opposite the head thereof is called a tip in this description. Threads are provided on the circumferential inner surfaces of the walls of the housing 40 defining essentially a half of the hole 41 near the entrance thereof, that is, the upper portion of the hole 41. The screw 43 has a coaxial cylindrical boss 62 partway down the shaft from the head 60 thereof. Mating threads are provided about the boss 62. The screw 43 engages the housing 40 via the threads, so that rotation of the screw 43 allows the screw 43 to move axially through the hole 41.

The end of the hole 41 near the bottom 42 forms a chamber 44 of constant inside diameter. Essentially a half of the screw 43 near the top 61, that is, the lower portion of the screw 43, has a constant outside diameter essentially the same as the inside diameter of the chamber 44, and slidably extends into the chamber 44. Therefore, the lower half or portion of the screw 43 near the top 61 is essentially flush with the walls of the housing 40 defining the chamber 44. The bottom 42 of the hole 41, that is, the bottom of the chamber 44 is in the form of a conical recess. The lower or bottom surface of the screw top 61 has a coaxial cylindrical recess 45. The inside diameter of the recess 45 is slightly smaller than the outside diameter of the screw tip 61, so that the screw tip 61 is in the form of a thin-walled cylindrical or annular shell projecting axially into the chamber 44. The ceiling of the recess 45 is in the form of a conical recess inverted with respect to the bottom 42 of the valve chamber 44.

The housing 40 is also provided with an inlet port 46 and an outlet port 47 both extending perpendicular to the axis of the hole 41, that is, the axis of the chamber 44. The ports 46 and 47 are coaxial. The ports 46 and 47 extend from the outside of the housing 40 to the chamber 44 and open into the latter. In other words, the ports 46 and 47 extend from the chanber 44 to the outside of the housing 40 in the opposite radial directions with respect to the axis of the chamber 44. The openings of the ports 46 and 47 to the chamber 44 are defined in opposing circumferential inner surfaces of the housing 40 defining the chamber 44. The positional relationship between the lower part of the screw 43 near the tip 61 and the openings of the ports 46 and 47 to the chamber 44 is chosen so that the lower part of the screw 43 can gradually block and expose the openings as the screw 43 moves axially while rotating.

An inlet tube 48 fits into the port 46 and projects from the housing 40. An outlet tube 49 fits into the port 47 and projects from the housing 40. The inlet tube 48 is connected, by means of a suitable pipe or hose (not shown), to the main air passage 10 (see FIG. 1) upstream of the throttle valve 14. The outlet tube 49 is connected, also by means of a suitable pipe or hose (not shown), to the main air passage 10 downstream of the throttle valve 14. In this way, the tubes 48 and 49, the ports 46 and 47, and the chamber 44 form part of the auxiliary air passage 30 (see FIG. 1).

The housing 40 has another hole 90 extending therethrough, and is attached to a suitable stationary member, such as an engine body, by means of a mounting pin or bolt passing through the hole 90.

The screw upper end or head 60 is normally recessed within the hole 40, and has a diametrical slot 50. Inserted into the hole 40 through the entrance thereof, a suitable tool, such as a screwdriver, can engage the screw 43 via the slot 50 to enable the screw 43 to be manually rotated.

A ring rubber 51 is attached, for example by baking, around the screw 43 between the head 60 and the boss 62. The ring rubber 51 sealingly engages the walls of the housing 40 defining the hole 40 in order to prevent air leakage from the chamber 44. The ring rubber 51 also serves to hold the screw 43 in place after screw adjustment.

The walls of the housing 40 defining the openings of the ports 46 and 47 to the chamber 44 project radially inwards with respect to the axes of the ports 46 and 47 so as to form annular projections 52 and 53 with thin walls. The surfaces of the projections 52 and 53 opposing the chamber 44 are flush with the circumferential inner surfaces of the housing 40 defining the chamber 44. The openings of the ports 46 and 47 to the chamber 44, that is, the openings through the projections 52 and 53, are gradually blocked or exposed as the lower part of the screw 43 moves axially downwards or upwards in the chamber 44. The bottom 42 and the recess 45 are designed so that the effective cross-sectional area of the chamber 44 with respect to the air flow is greater than that of the openings through the projections 52 and 53 when fully exposed. Since the screw top 61 is the annular shell or hollow cylinder, the projections 52 and 53, and the screw tip 61 cooperate to define separated first and second variable restrictions or orifices 54 and 55 which adjustably reduce the local cross-sectional area of the auxiliary air passage 30 and thus which determine the effective cross-sectional area of the auxiliary air passage 30. In this case, the degrees of exposure of the openings through the projections 52 and 53 directly decide the effective cross-sectional areas of the respective restrictions 54 and 55. Since the degrees of exposure of the openings through the projections 52 and 53 depend on the axial position of the screw 43, the effective cross-sectional area of the auxiliary air passage 30 ultimately depends on the axial position of the screw 43. The projections 52 and 53 are symmetrical with respect to the axis of the chamber 44 and the plane of the lowermost edge of the screw 43 is perpendicular to the axis of the chamber 44, so that the degree of exposure of the opening through the first projection 52 is always equal to that of the opening through the second projection 53. In other words, the first and second restrictions 54 and 55 are symmetrical or identical. The openings through the projections 52 and 53 are circular.

In operation, while the throttle valve 14 is closed to idle the engine, air flows through the auxiliary air passage 30 into the combustion chambers via the first and second restrictions 54 and 55. In this case, the flow rate of air drawn into the combustion chambers is determined by the axial position of the screw 43, since the effective cross-sectional area of the auxiliary air passage 30 depends on the axial position of the screw 43.

Figure 3:
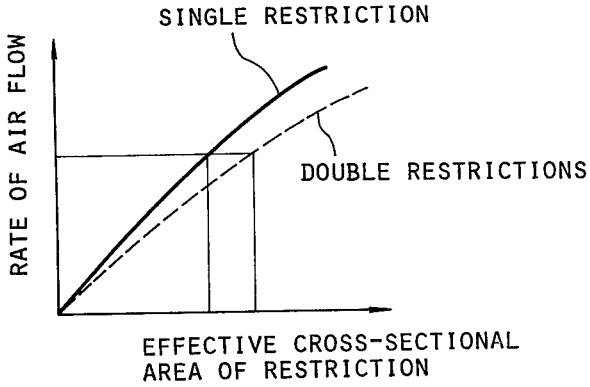
FIG. 3 is a graph showing the relationship between the rate of air flow and the effective cross-sectional area of each restriction, wherein the broken curve is obtained in the case of double restrictions in accordance with this invention and the solid curve is obtained in the case of a single restriction.

As shown in FIG. 3, variation of the rate of air flow into the combustion chambers according to variation of the effective cross-sectional areas of the restrictions 54 and 55 in this invention (shown by the broken curve "double restrictions") has a smaller slope than when one of the restrictions 54 and 55 is eliminated or when only a single restriction is provided (shown by the solid curve "single restriction"). Note that the characteristic curves in FIG. 3 are obtained during idling. As a result, accumulation of air-borne dirt or other contaminants on the surfaces of the restrictions 54 and 55 reduces the rate of air flow to a lesser degree than in the case of a single restriction. Thus, the idle-adjusting device 11 is less sensitive to accumulation of contaminants or dirt thereon.

Since the walls of the projections 52 and 53, and those of the screw tip 61 are thin, the portions of the restrictions 54 and 55 which actually determine the effective cross-sectional area of the auxiliary air passage 30 have reduced total surface areas. The reduced areas result in a reduction of the probability of accumulation of air-borne dirt or other contaminants on such essential portions of the restrictions 54 and 55. Preferably, the walls of the projections 52 and 53, and those of the screw tip 61 are considerably thin relative to the cross-sectional area of the non-restricted portion of the ports 46 and 47. For example, the thickness of the walls of the cylindrical shell 61, and that of the walls of the projections 52 and 53 are 0.3 to 1.5 mm, and are practically 0.5 to 1.0 mm.

Figure 4:
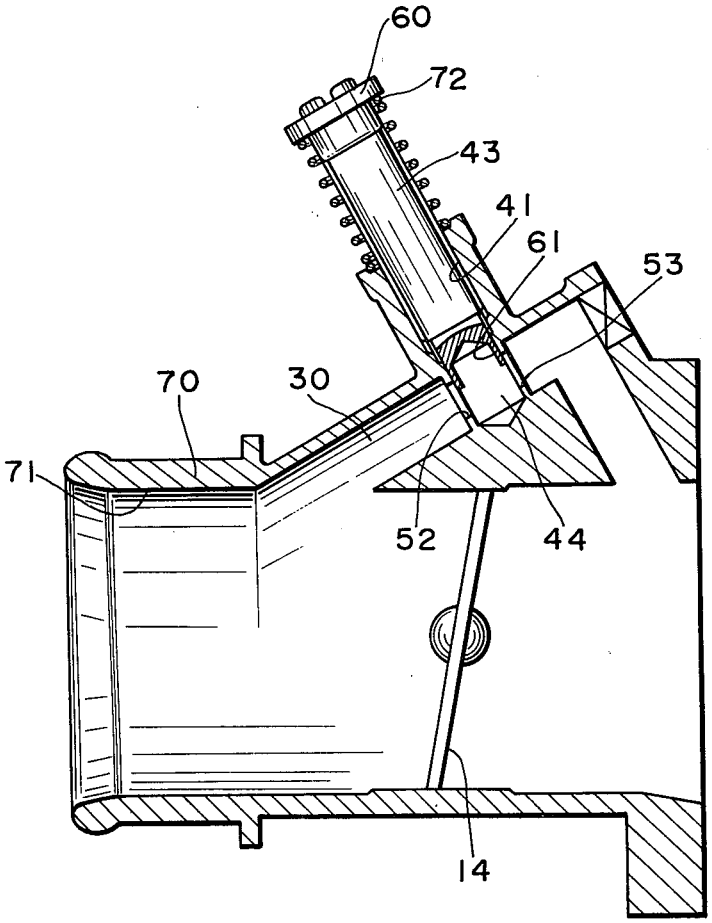
FIG. 4 is a longitudinal section view of an idle-adjusting device according to a second embodiment of this invention.

FIG. 4 shows an idle-adjusting device 11 according to a second embodiment of this invention. The second embodiment is designed in a manner essentially similar to that of the first embodiment except for the following arrangements.

The auxiliary air passage 30 is integral to the walls of a throttle housing 70, which has a bore 71 extending therethrough and forming part of the main air passage 10 (see FIG. 1). The throttle valve 14 is disposed in the bore 71 to be accommodated in the housing 70. One end of the auxiliary passage 30 is connected to the bore 71 upstream of the throttle valve 14, and the other end thereof is connected to the bore 71 downstream of the throttle valve 14.

The walls of the housing 70 have a hole 41 into which the screw 43 is inserted. Part of the hole 41 near the bottom thereof forms part of the auxiliary air passage 30 or a chamber 44, into which the annular or hollow cylindrical tip 61 of the screw 43 opposite its head 60 projects. The walls of the housing 70 project into the passage 30 in such a manner as to form annular projections 52 and 53 adjacent to the chamber 44.

The screw 43 projects outwardly from the hole 41 or the housing 70. A compressed helical spring 72 is seated between the outer surface of the housing 70 and the lower surface of the flanged head 60 of the screw 43 outside the housing 70, urging the screw 43 away from the hole 41 to hold the screw 43 in place.

In the second embodiment, the housing of the idle-adjusting device 11 is, thus, formed integrally with the housing 70 of the throttle valve 14.

It should be understood that further modifications and variations may be made in this invention without departing from the spirit and scope of this invention as set forth in the appended claims.

What is claimed is:

1. An idle-adjusting device for an engine having an air intake passage, a throttle valve disposed in the air intake passage, and an auxiliary passage communicating with the air intake passage in such a manner as to bypass the throttle valve, the adjusting device comprising:

(a) a first variable restriction provided in the auxiliary passage, the first restriction adjustably reducing the local cross-sectional area of the auxiliary passage; and (b) a second variable restriction provided in the auxiliary passage downstream of the first restriction, the second restriction adjustably reducing the local cross-sectional area of the auxiliary passage;

(c) the first and second restrictions adjustably determining the effective cross-sectional area of the auxiliary passage.

2. An idle adusting device as recited in claim 1, wherein the first and second restrictions include respectively first and second stationary projections extending into the auxiliary passage, and wherein the first and second restrictions include a common member movably projecting into the auxiliary passage between the first and second projections and adjacent to the first and second projections to adjustably reduce the local cross-sectional areas of the auxiliary passage in conjunction with the first and second projections.

3. An idle adjusting device as recited in claim 2, wherein the first and second projections extend perpendicular to the longitudinal axis of the auxiliary passage and are annular.

4. An idle adjusting device as recited in claim 3, wherein the common member is in the form of a cylindrical shell extending perpendicular to the longitudinal axis of the auxiliary passage, and is movable in a direction perpendicular to the longitudinal axis of the auxiliary passage to adjustably expose and block the openings through the first and second projections and thereby adjust the cross-sectional areas of the auxiliary passage.

5. An idle adjusting device as recited in any one of claims 1 to 4, wherein the first and second restrictions are thin relative to the cross-sectional area of the non-restricted portion of the auxiliary passage.

* * * * *